US005480113A

United States Patent [19]

Hachenberg

[11] Patent Number: 5,480,113

[45] Date of Patent: Jan. 2, 1996

[54] WASTE BAG HOLDER

[76] Inventor: Bernhard Hachenberg, 59 Cassia St., Dee Why, New South Wales, 2099, Australia

[21] Appl. No.: 256,744

[22] PCT Filed: Jan. 21, 1993

[86] PCT No.: PCT/AU93/00028

§ 371 Date: Jul. 21, 1994

§ 102(e) Date: Jul. 21, 1994

[87] PCT Pub. No.: WO93/14980

PCT Pub. Date: Aug. 5, 1993

[30] Foreign Application Priority Data

Jan. 22, 1992 [AU] Australia ..... PL0518

[51] Int. Cl.[6] ..... B65B 67/04

[52] U.S. Cl. ..... 248/100

[58] Field of Search ..... 248/95, 97, 99, 248/100, 101, 908; 141/314, 391; 220/404

[56] References Cited

U.S. PATENT DOCUMENTS

| | | | |
|---|---|---|---|
| D. 334,449 | 3/1993 | Gaba et al. | D34/6 |
| 2,896,828 | 7/1959 | Banta | 224/42.46 |
| 3,722,561 | 3/1973 | O'Leary et al. | 141/316 |
| 3,870,261 | 3/1975 | McSwain | 248/101 |
| 4,695,020 | 9/1987 | Collins | 248/95 X |
| 4,913,308 | 4/1990 | Culbertson | 220/404 |
| 4,955,566 | 9/1990 | Bolich | 248/101 |
| 5,020,751 | 6/1991 | Larkin | 248/99 |

FOREIGN PATENT DOCUMENTS

| | | |
|---|---|---|
| 63832/90 | 4/1991 | Australia . |
| 2023111 | 11/1992 | Canada . |
| 2087306 | 12/1971 | France . |
| 2452902 | 10/1980 | France . |
| 754064 | 8/1956 | United Kingdom . |
| 1049489 | 11/1966 | United Kingdom . |

*Primary Examiner*—Ramon O. Ramirez
*Attorney, Agent, or Firm*—Kimmel, Crowell & Weaver

[57] ABSTRACT

A waste bag holder includes a frame mountable on a support such as a cupboard door. The frame has inwardly projecting hooks from which the bag is suspended. A lid mounted between the frame sides defines a small rear mouth portion and a larger front mouth portion for receiving waste. Integral lips on the frame direct waste into the bag. A detachable skirt suspended from the frame conceals the bag from view.

6 Claims, 4 Drawing Sheets

WASTE BAG HOLDER

BACKGROUND OF THE INVENTION (1) Field of the Invention

This invention relates to a waste bag holder.

(2) Prior Art

There is an on-going need for an efficient method of disposing of domestic kitchen or bathroom waste. While waste bins are readily available, they are untidy and messy to use, especially if they are not lined with a disposable liner.

Most supermarkets provide plastic bags for shoppers to transport their purchases from the shop to home. Some people use these bags for e.g. kitchen waste disposal, by hanging them from the knobs on kitchen- or bathroom-cupboard doors. The bags are untidy to look at and liable to attract flies or other insects to the waste therein.

AU-B-61611/86 (556230) (Bautex Bantechnik Fur Projektierung und Baudurchfuhrung AG and Bernd Hermann) does disclose a waste bag support assembly where the waste bag can be covered by a spring biassed lid. This frame assembly requires the use of a waste bag support frame to be inserted in the waste bag and be engaged on a ledge of a support frame, and the bag is not concealed from view.

SUMMARY OF THE INVENTION

It is an object to provide a holder for such bags which is simple to use and which is aesthetically pleasing.

It is a preferred object to provide a holder when the bag is concealed.

It is a further preferred object to provide a holder which has a lid which may be hinged to allow the bag to receive waste from a bench top or a utensil, bowl or plate.

It is a still further preferred object to provide a holder which is easily cleaned, can be easily moved and maybe a "fashion accessory" for a kitchen or bathroom.

Other preferred objects will become apparent from the following description.

In a broad aspect the present invention resides in a waste bag holder, to hold supermarket or department store bags or the like, including:

a frame;

means to mount the frame on a support;

means to suspend a flexible container from the frame; and skirt means depending from the frame so that the flexible container is substantially surrounded by the skirt and the support.

The frame preferably has at least a rear wall and a pair of forwardly directed side arms.

Preferably the frame is a peripheral frame with a front wall interconnecting the forward ends of the side arms.

The frame may be formed of stainless steel, painted or powder-coated steel, aluminium (which may be painted, powder-coated or anodized), plastics, wood and/or a combination of same. The frame is preferably square, rectangular, circular, elliptical or D-shaped in top plan view. A downwardly, inwardly directed tongue may be provided on the rear wall of the frame to enter the mouth of a container suspended from the frame.

A lid is preferably provided on the frame and is preferably hinged intermediate the sides of the frame so that when open, the lid divides the frame into a small, rear mouth portion and a larger, front mouth portion.

The mounting means for the frame may include hooks, adhesive strips, screw fasteners or the like to secure the rear wall of the frame, preferably detachably, to the support e.g. a kitchen cupboard- or bathroom vanity-door. (The screw fasteners may be releasably engageable in slots or holes in the rear wall.) Alternatively, a sub-frame may be mounted on the support and the frame be releasably detachable therefrom. The frame may be releasably mountable by the methods hereinbefore described or by e.g. hooks or wedges engageable in complementary sockets.

The bag may be suspended from hooks or pins inwardly directed from the frame.

The hooks or pins may be formed integrally with the frame.

The skirt may be fixed to, or releasably detachable from the frame (e.g. by "VELCRO" (Registered Trade Mark)) and may be rigid, semi-rigid or flexible. The skirt may be manufactured of waterproof and/or washable material and printed or woven in a wide range of colours, patterns, designs. (The fabric of the skirt may match kitchen towels, pot holders, oven gloves and holders for the empty bags.)

BRIEF DESCRIPTION OF THE DRAWINGS

To enable the invention to be fully understood, preferred embodiments will now be described with reference to the accompanying drawings, in which.

DETAILED DESCRIPTION OF THE PREFERRED EMBODIMENTS

Figure 1:
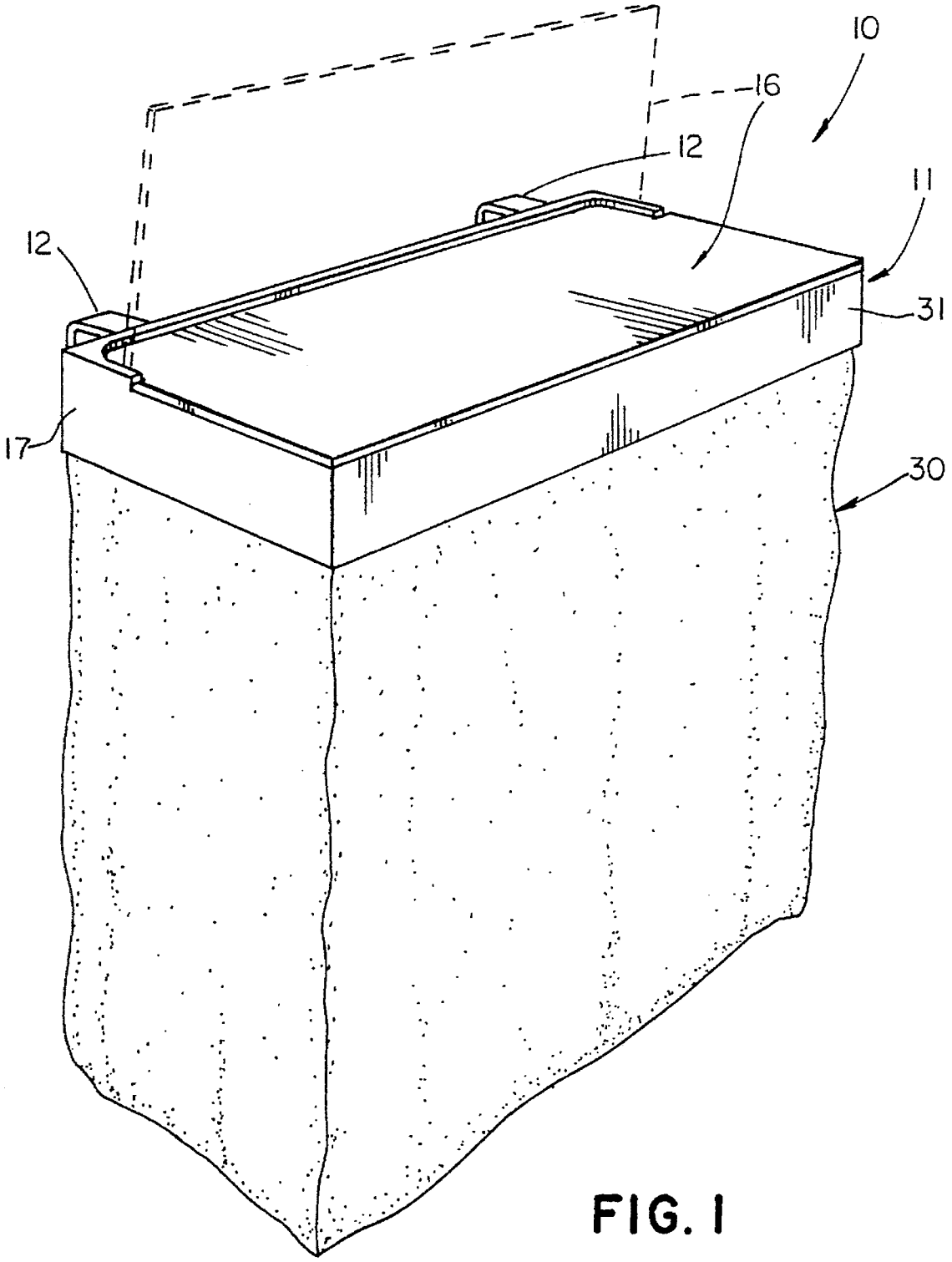
FIG. 1 is a perspective view of a first embodiment of a holder for use in a domestic kitchen.
Figure 2:
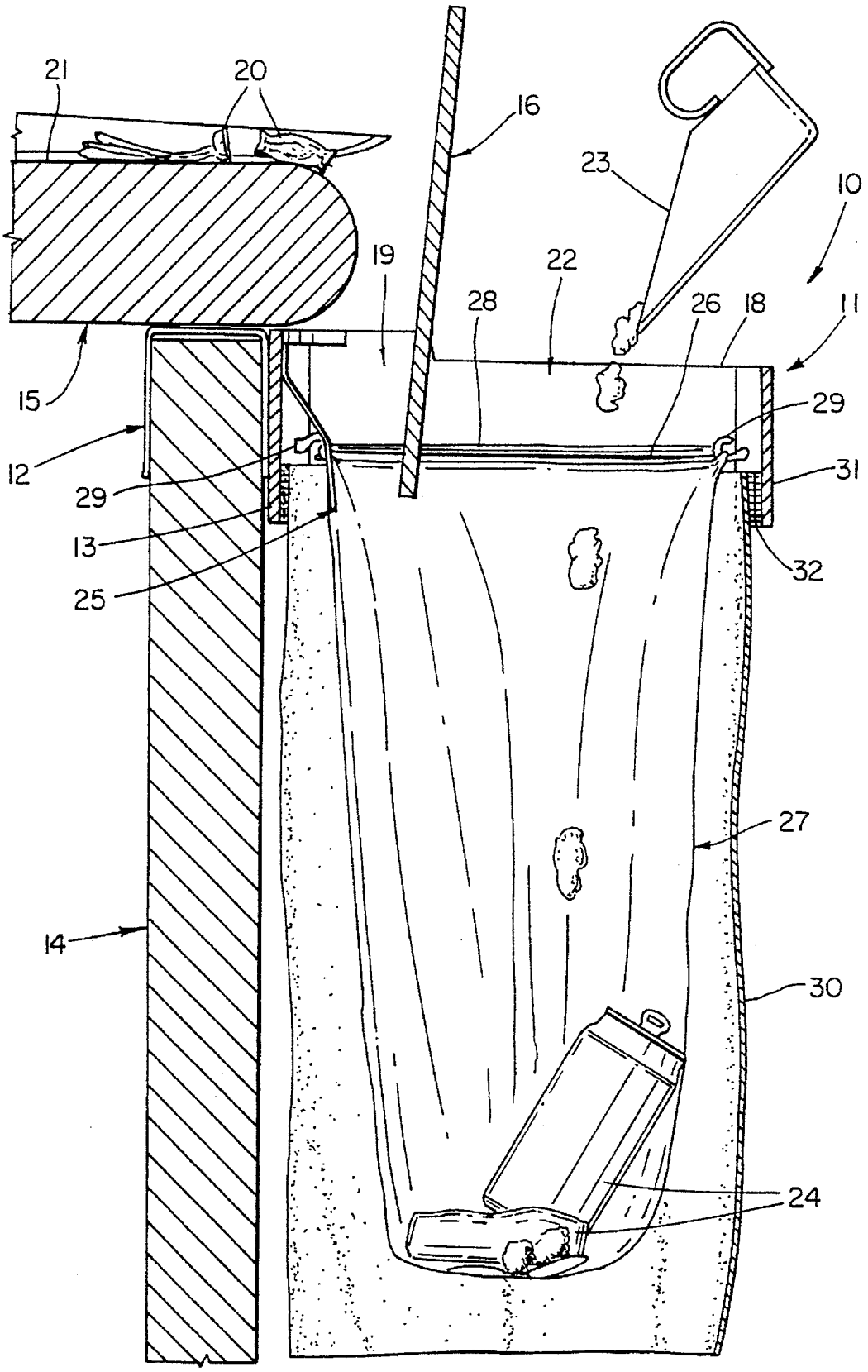
FIG. 2 is a sectional side view showing the holder in use.

Referring to FIGS. 1 and 2, the holder 10 has a substantially rectangular peripheral frame 11 of injection-moulded plastics material. A pair of hooks 12 fixed to, or integral with, the rear wall 13 of the frame 11 enable the holder 10 to be releasably mounted on a kitchen cupboard door 14, below the level of a kitchen bench 15.

A lid 16, of the same material as the frame 11, has a pair of pivot pins (not shown) releasably engaged in sockets (not shown) intermediate the side walls 17, 18 of the frame 11. The lid 16 is movable from a closed position (solid lines in FIG. 1) to an open position (dashed lines in FIG. 1, solid lines in FIG. 2) where it defines, with the frame, a small rear mouth portion 19 (to receive waste 20 swept or pushed from the bench top 21), and a larger front mouth portion 22 to receive waste e.g. from a dustpan 23, plate, bowl or the like or through which waste 24 may be deposited.

An integral lip 25, mounted on the inner face of the rear wall 13 of the frame 11, is forwardly and downwardly directed to direct the waste 20 passing through the rear mouth portion 19 through the mouth 26 of the supermarket bag 27 suspended by its loops 28 releasably attached to hooks 29 at the corners of the frame 11.

A skirt 30, of washable fabric, depends from the side walls 17, 18 and front wall 31 of the frame 11 and is releasably secured by "VELCRO" (Registered Trade Mark) strip 32. As shown the skirt 30 and the cupboard door 14 surround the bag 27 and the lid 16 prevents the ingress of unwanted pests to the interior of the bag.

When the bag 27 is full of waste 24, the loops 28 of the bag 27 are released from the hooks 29 and the bag can be removed by pulling it past one side of the skirt 30.

The skirt 30 can be removed and washed when dirty, or it can be replaced by another skirt e.g. change the aesthetic appeal.

If required, the holder 10 can be lifted from the cupboard door 14 and can be taken to another location in the dwelling to receive waste i.e. the holder can go to the waste, or vice versa.

In commercial applications, it is preferable that the frame 11 be manufactured from stainless steel, for easy hygienic cleaning and that the lid 16 be easily removable.

Figure 3:
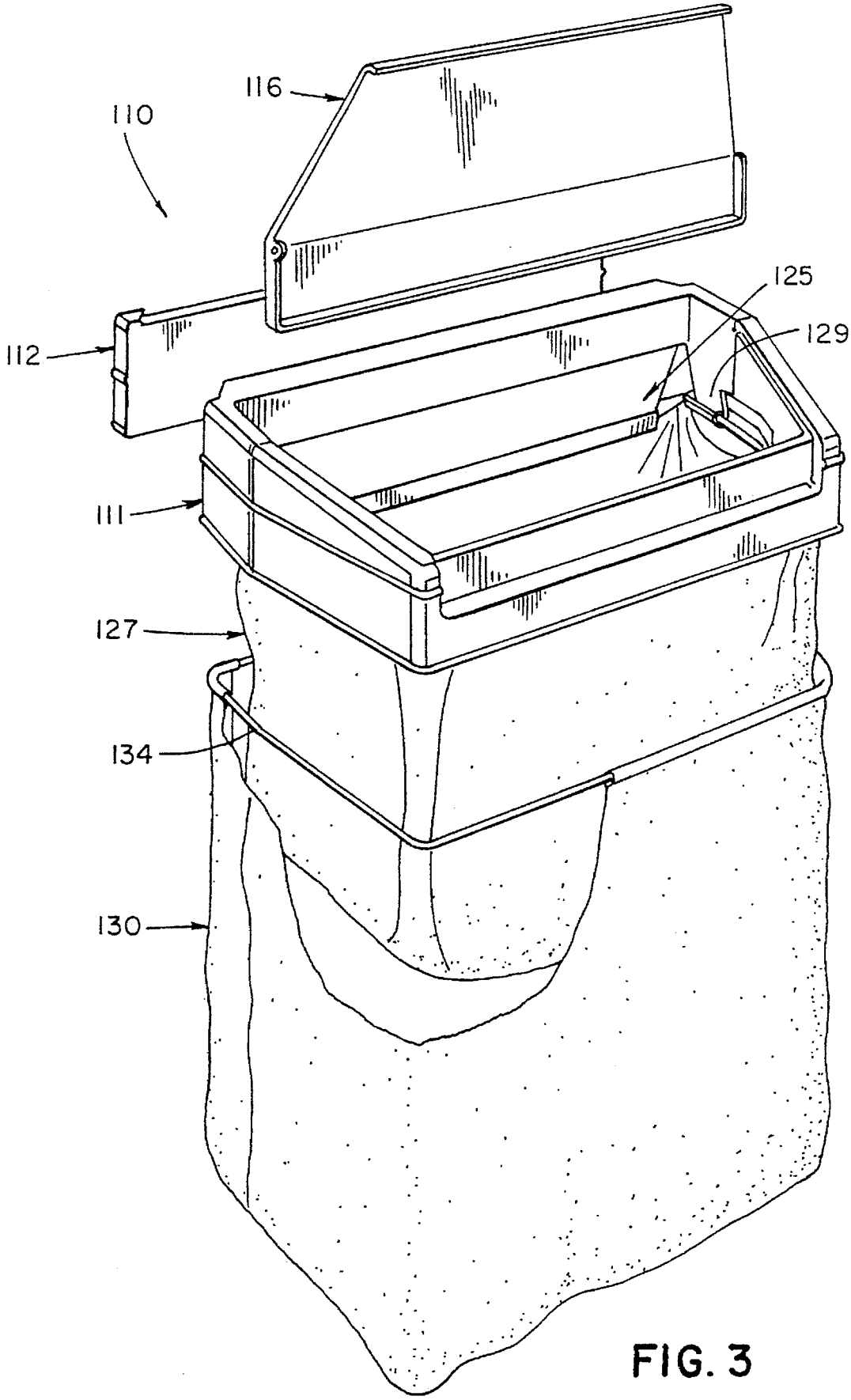
FIG. 3 is an "exploded" front perspective view of a second embodiment of the holder fitted with a bag.
Figure 4:
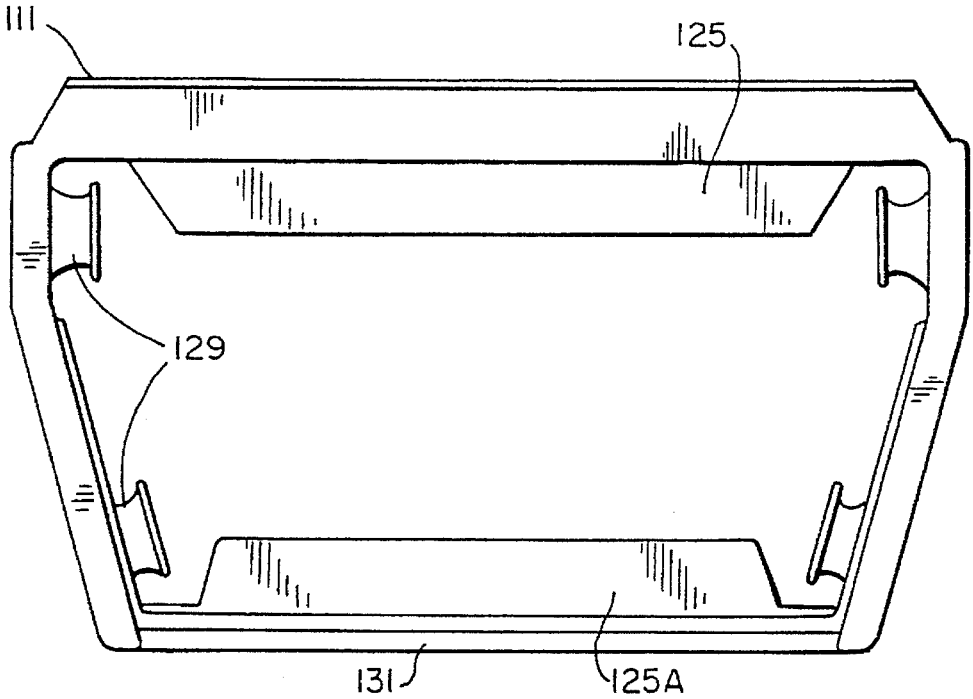
FIG. 4 is a plan view of the frame of the holder with the lid removed)
Figure 5:
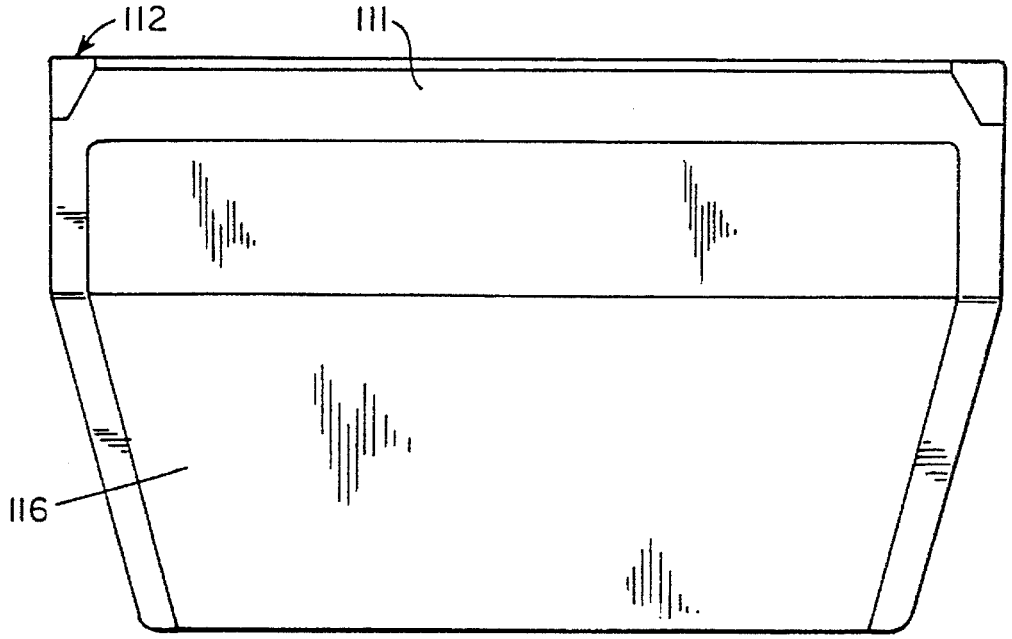
FIG. 5 is a top plan view of the holder.

Referring now to FIGS. 3 to 5, the holder 110 also has its frame 111 injection moulded of plastics material but the hooks 129 to support the supermarket bag 127 are moulded integrally with the frame 111.

A mounting bracket 112 may be fixed to the cupboard door 14 by suitable fasteners or clips (not shown).

The skirt 130 is suspended from a wire loop 134 which is releasably engageable with clips (not shown) on the frame 111.

As shown in FIGS. 4, an integral lip 125A may be provided on the front wall 131 of the frame 111 to direct the waste into the mouth of the waste bag 127.

While the holders 10, 110 have been described with reference to supermarket or department store bags, their size may be varied and specially designed bags (e.g. of larger capacity) may be provided and used.

Various changes and modifications may be made to the embodiments described without departing from the present invention defined in the appended claims.

I claim:

1. A waste bag holder for holding shopping bags, including a frame having a rear wall, a pair of forwardly directed side arms, and a front wall interconnecting said arms;

means for mounting the frame on a support;

means for suspending a flexible container from the frame; and a skirt depending from the frame so that the flexible container is substantially surrounded by the skirt and the support;

wherein the frame is square, rectangular, circular, elliptical or D-shaped in top plan view; and further comprising a downwardly, inwardly directed lip on the rear wall of the frame for entering the mouth of a bag or container suspended from the frame.

2. The invention of claim 1, further comprising a lid hingedly mounted between the side arms of the frame so that when open, the lid divides the frame into a small, rear mouth portion and a larger, front mouth portion.

3. The invention of claim 1, wherein said suspending means comprises a plurality of pins or hooks inwardly directed from the frame.

4. The invention of claim 1, further comprising a second inwardly, downwardly directed lip extending from the front wall of the frame and receivable within the mouth of the bag or container to direct waste into the bag or container.

5. The invention of claim 1, where in the skirt is attached to the frame.

6. The invention of claim 5, wherein the skirt extends below the bag or container and cooperates with the support to conceal the bag or container from view from the front or either side.

* * * * *